United States Patent [19]

Derby

[11] 3,946,188

[45] Mar. 23, 1976

[54] MICROWAVE HEATING APPARATUS WITH BROWNING FEATURE

[75] Inventor: Palmer P. Derby, Weston, Mass.

[73] Assignee: Raytheon Company, Lexington, Mass.

[22] Filed: June 19, 1975

[21] Appl. No.: 588,454

[52] U.S. Cl. ..... 219/10.55 E; 99/DIG. 14

[51] Int. Cl.[2] ..... H05B 9/06

[58] Field of Search 219/10.55 E, 10.55 F, 10.55 M; 99/451, DIG. 14

[56] References Cited

UNITED STATES PATENTS

| | | | |
|---|---|---|---|
| 3,230,864 | 1/1966 | Krajewski | 99/DIG. 14 |
| 3,591,751 | 7/1971 | Goltsos | 219/10.55 E |
| 3,662,141 | 5/1972 | Schauer, Jr. | 219/10.55 E |
| 3,701,872 | 10/1972 | Levinson | 219/10.55 E |
| 3,809,845 | 5/1974 | Stenstrom | 99/451 X |
| 3,845,266 | 10/1974 | Derby | 219/10.55 E |
| 3,857,009 | 12/1974 | MacMaster et al. | 219/10.55 E |
| 3,878,350 | 4/1975 | Takagi | 219/10.55 E |
| 3,881,027 | 4/1975 | Levinson | 219/10.55 E |

FOREIGN PATENTS OR APPLICATIONS

| | | | |
|---|---|---|---|
| 1,596,475 | 7/1970 | France | 99/DIG. 14 |
| 7,004,169 | 9/1970 | Netherlands | 219/10.55 E |

*Primary Examiner*—Arthur T. Grimley
*Attorney, Agent, or Firm*—Edgar O. Rost; Joseph D. Pannone; Herbert W. Arnold

[57] ABSTRACT

Apparatus for heating with microwave energy is disclosed comprising a plurality of spaced microwave elements in a flexible webbing adapted to fit the contour of any object to be cooked. The microwave elements, such as cups, have a height of substantially one-quarter of a wavelength. An intense fringing electric field pattern results with the electric field being 180° out of phase in close proximity to the open ends of the elements. The material contacted by these ends will be suitably browned or seared. An impedance matching dielectric member may also be provided in contact with the apparatus.

3 Claims, 4 Drawing Figures

MICROWAVE HEATING APPARATUS WITH BROWNING FEATURE

BACKGROUND OF THE INVENTION

1. Field of the Invention

The invention relates to apparatus for use in microwave heating.

2. Description of the Prior Art

Microwave heating has become increasingly popular in the preparation of, particularly, foodstuffs. The microwave energy is radiated within an enclosure from an energy source, such as a magnetron. The waves are radiated and reflected within the enclosure and result in high frequency oscillatory movement of the molecules in a load to cause heating by molecular friction.

The materials being heated absorb energy from the waves in a manner that varies inversely as the distance from the surface to the interior. This variation in loss is usually not sufficient to cause significant change in the coloration from the surface to the interior. For this reason, some technique is desired which will permit higher field concentrations that decrease rapidly with distance to be presented to the surface of the materials being heated. Prior art techniques for controlling the surface coloration have included the incorporation of electric or gas broiling elements in the microwave oven. A coating of a food additive having high energy absorption characteristics as a coating of the outer surfaces has also been suggested. Another example of a prior art teaching is U.S. Pat. No. 3,591,751 issued July 6, 1971 to C. E. Goltsos which discloses a plurality of half-wavelength rods to cause rapid absorption of the energy by the rods. The absorbed heat is then transferred by conduction to a supported load. The heating of the rods by the absorbed energy can lead to problems if the rods are accidentally touched before they are sufficiently cooled.

Another example of a prior art apparatus is described in U.S. Pat. No. 3,857,009 issued Dec. 24, 1974 to G. MacMaster et al. and assigned to the assignee of the present invention. This structure utilizes high and low dielectric constant materials to provide a fringing electric field pattern having a 180° phase differential in close proximity to the exterior surfaces of the load. All of the foregoing prior art teachings are difficult to apply in the case of irregularly contoured loads such as a meat roast or fowl. A need arises, therefore, for microwave apparatus to be utilized for bulky or irregular contoured objects.

SUMMARY OF THE INVENTION

In accordance with the teachings of the present invention a webbing of a suitable dielectric material is provided having sufficient flexibility to permit the placement on any contoured surface. A plurality of conductive microwave elements are supported in the flexible means. Each of the conductive elements comprises a cup-shaped member having a closed end and open end. The walls have an overall height of approximately one-quarter of a wavelength of the operating frequency of the microwave energy. The waves traveling along the conductive walls of the metallic members result in a fringing electric field pattern adjacent the open ends of the members. The intense electric field has a substantially 180° phase differential. The disclosed device does not absorb energy but arranges it for absorption by the material being heated for a more efficient technique. The surfaces contacted by the open ends of the conductive members will become effectively browned or seared as desired.

An alternative embodiment incorporates shorted sections of parallel plate transmission line which are spaced throughout the flexible webbing material. The shorted sections of parallel plate line provide a similar fringing electric field pattern adjacent the open ends of the line elements.

BRIEF DESCRIPTION OF THE DRAWINGS

Details of the invention will be readily understood after consideration of the following description of an illustrative embodiment and reference to the accompanying drawings, wherein.

DESCRIPTION OF THE PREFERRED EMBODIMENT

Figure 1:
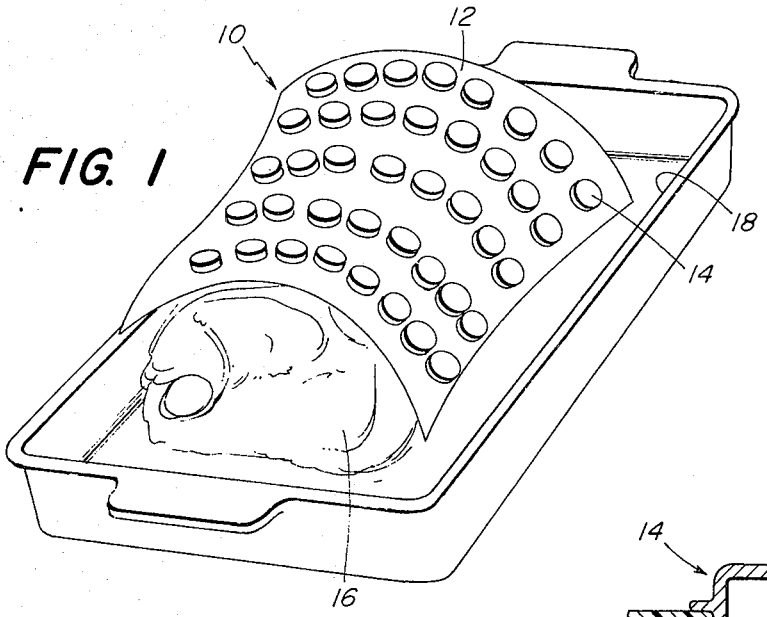
FIG. 1 is an isometric view of the illustrative embodiment of the invention.

Referring to FIG. 1 an embodiment 10 of the invention is shown. A web member 12 of a flexible microwave permeable material is provided having a substantial area to encompass an article to be heated. A plurality of microwave heating elements 14 of a conductive material are disposed withing the web member 12 and provide for the concentration within the microwave energy in the region adjacent to the ends of the heating elements which contact a load to be heated. The combined web member and heating elements may be referred to as a blanket.

Numerous plastic dielectric materials such as Teflon may be utilized for the web member 12. This material is approved for use with foods by the Food and Drug Administration. Any other similar approved materials may be provided.

Figure 2:
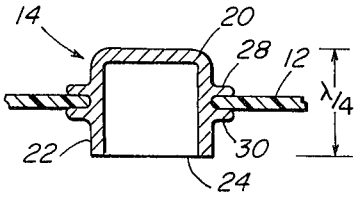
FIG. 2 is a cross-sectional view of a metallic element of the invention.

Each of the heating elements 14 as shown in FIGS. 1 and 2, is substantially cup-shaped and is of a conductive material. In this configuration the element has a closed end 20 and a circular body portion 22 extending perpendicular to this end and defining an open end 24. The body portion 22 has a height of approximately one-quarter of a free space wavelength of the microwave energy which is radiated within the oven enclosure. The cup-shaped heating elements are supported within the web member 12 which is provided with a plurality of apertures dimensioned to provide a snug fit for the microwave element circular bodies 22. As shown in FIG. 2 each of the microwave element circular bodies 22 is provided with circular protrusions 28 and 30. The elements 14 are pushed through the apertures in the web member in such a manner that the webbing material is disposed between the protrusions.

Figure 3:
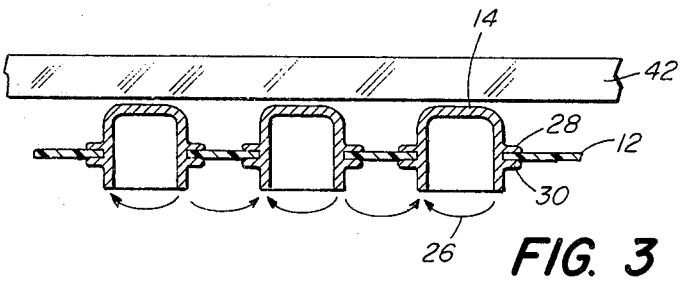
FIG. 3 is a cross-sectional view of the illustrative embodiment with an impedance matching structure.

The item to be heated, such as a roast 16, is supported in a roasting utensil 18. The heating blanket, comprising web member 12 and the microwave heating elements 14, is positioned in contact with the load 16 and the web member 12 makes it possible for irregular contoured objects to be efficiently heated as well as browned or seared. The microwave energy radiated within an enclosure of the type well known in the art impinges on the cup elements 14. The radiated energy consists of numerous complex wave mode patterns and it is difficult to uniformly heat a load without some uniformity in the pattern of the energy. In the practice of the invention the energy fields are converted to result in an electric field distribution 180° out of phase providing a fringing electric field adjacent the outer end 24 of the cup member as shown in FIG. 3 and designated by the vectors 26. The complex mode distribution of the microwave energy is thereby convected and concentrated in the region closely adjacent to the ends of the microwave elements and the field decreases rapidly exponentially a short distance away from the ends. This concentrated energy is available for heating the load contacted by the ends of the elements. The foregoing heating pattern results in very little direct heating of the microwave elements which differentiates this apparatus from the prior art where the elements are directly heated and then the energy is transferred by thermal conduction to the article being heated.

Referring next to FIG. 3 means for the matching of the impedance of the load to be heated to assist in the coupling in the free space waves is disclosed. A body of a dielectric material 42 having a predetermined dielectric constant is selected and is disposed between the heating elements and the free space waves. The load impedance matching means will assure efficient conversion of the free space energy to the predetermined fringing field electric pattern adjacent the ends of the heating elements.

Figure 4:
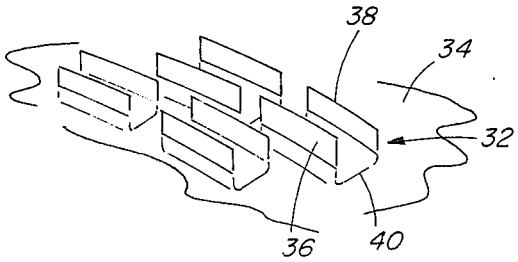
FIG. 4 is an isometric view of an alternative embodiment of the invention.

Referring to FIG. 4 an alternative embodiment of the invention is illustrated. A plurality of shorted parallel plate transmission lines 32 are disposed in an array supported by flexible web member 34. The parallel plate sections each include a pair of side members 36 and 38 joined together by a common wall 40. The parallel plate embodiment is a conductive material and the fringing fields will be disposed adjacent the open ends of the side members 36 and 38. This linear configuration will provide substantially similar intense fringing electric field patterns as the cup shaped elements.

There is thus disclosed a microwave heating apparatus for irregular shaped objects which will be blanketed by a large number of heating elements each providing a fringing electric field heating pattern. Numerous modifications or alterations will be evident to those skilled in the art. For example, the cup members may be square, oval or rectangular as well as round. The foregoing detailed description of the preferred embodiment is, therefore, intended to be interpreted broadly.

I claim:

1. Apparatus for heating with microwave energy comprising:

a flexible member of a microwave permeable material;

a plurality of spaced conductive elements supported by said flexible member;

each of said elements defining wall structure having a height of substantially one-quarter of a wavelength of the microwave energy;

said elements defining adjacent one end thereof a fringing electric field pattern in the presence of microwave radiated energy for heating of surfaces in close proximity to said ends.

2. Apparatus according to claim 1 wherein said conductive elements are of a cup-shaped configuration having a closed end and a circular body portion extending perpendicular to the closed end.

3. Apparatus according to claim 1 wherein said conductive elements comprise parallel plate wall members joined together by a common wall member.

* * * * *